United States Patent [19]

Bradford

[11] Patent Number: 4,804,285

[45] Date of Patent: Feb. 14, 1989

[54] PRINTHEAD TRANSPORT APPARATUS

[75] Inventor: Robert G. Bradford, Bonnybridge, Scotland

[73] Assignee: Unisys Corporation, Blue Bell, Pa.

[21] Appl. No.: 911,149

[22] Filed: Sep. 24, 1986

[30] Foreign Application Priority Data

Nov. 30, 1985 [GB] United Kingdom ..... 8529522

[51] Int. Cl.[4] ..... B41J 25/28; B41J 19/14

[52] U.S. Cl. ..... 400/320; 400/328; 400/313; 74/89.17; 74/89.22

[58] Field of Search ..... 400/144.2, 144.3, 313, 400/317, 320, 322, 323, 328; 74/89.17, 89.21, 89.22, 422, 424.5, 424.6; 424/153, 167, 168, 169, 170, 171; 360/101, 105, 106, 104

[56] References Cited

U.S. PATENT DOCUMENTS

| | | | |
|---|---|---|---|
| 396,430 | 1/1889 | Reichel | 74/89.22 |
| 2,571,427 | 10/1951 | Drachman | 74/89.21 |
| 2,844,788 | 5/1959 | Clark | 74/89.22 |
| 3,270,572 | 9/1966 | Zimmerle | 74/89.22 |
| 3,273,408 | 9/1966 | Nagel et al. | 74/89.22 |
| 3,926,061 | 12/1975 | Paulson | 400/144.2 |
| 4,303,347 | 12/1981 | Siegenthaler | 400/328 |

FOREIGN PATENT DOCUMENTS

| | | | |
|---|---|---|---|
| 2039199 | 2/1972 | Fed. Rep. of Germany | 400/320 |
| 32622 | 3/1980 | Japan | 400/320 |
| 41204 | 3/1980 | Japan | 400/320 |
| 87057 | 5/1983 | Japan | 400/328 |
| 107379 | 6/1983 | Japan | 400/320 |

*Primary Examiner*—David A. Wiecking

*Attorney, Agent, or Firm*—Mark T. Starr

[57] ABSTRACT

Disclosed is a precision printhead transport apparatus. The apparatus includes a differential wheel rotatably mounted upon belt or a printhead carriage which is constrained to move along a printing path. A first portion of an endless belt or band is looped around a first portion of the differential wheel having a first radius and a second portion of the band is looped around a second portion of the differential wheel having a second radius. The band further passes around two pulleys positioned on opposite sides of the differential wheel, one of the pulleys being an idler pulley and the other a driven pulley. A course stepping motor drives the driven pulley and the action of the differential wheel assures that gross rotation of the driven pulley produces only small linear displacement of the printhead carriage.

Embodiments disclosed include both smooth and toothed bands and the use of a pair of rigid racks in place of the endless band. Also disclosed are modifications providing for a rapid printhead carriage return stroke accomplished by disengagement of the rack or band from one portion of the differential wheel.

14 Claims, 4 Drawing Sheets

FIG. 1
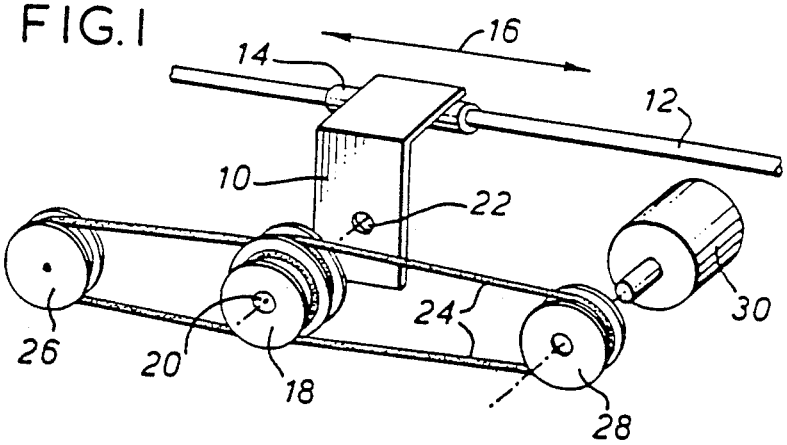
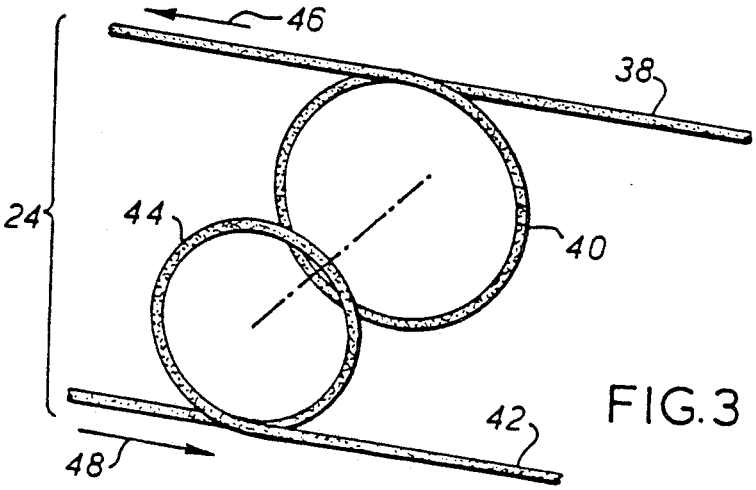
FIG. 3

PRINTHEAD TRANSPORT APPARATUS

BACKGROUND OF THE INVENTION

The present invention relates to an apparatus for transporting a carriage along a path. The invention particularly relates to such an apparatus used to transport a printhead along a line whereon characters are to be printed in a typewriter or printer.

It is known in the typewriter and computer controlled printing machines arts to transport a printing module or printhead along a line of printing, adjacent to a platen. Such printers typically employ dot matrix, daisy wheel or thermal devices to print upon paper held against the platen.

In use, the printhead is transported along the line of print such that adjacent characters printed on the paper are properly spaced apart. This transportation of the printhead, in the prior art, is achieved by means of belts, leadscrews, wires and other devices linked to a printhead carriage constrained by tracks, sliders and other means to move along the printing path. The distance moved by the printhead between successive printing operations is small, and in consequence the quality of the drive mechanism for the printhead carriage is required to be high. In the prior art, it is known to use stepping motors to drive the belts or wire, in which instance it is necessary for the stepping motors to be of high quality and accuracy, and to have many steps of angular position in each full rotation. These prior art solutions have the further disadvantage that the quality of the mechanical parts is required to be extremely high since drive from a motor is applied more or less directly to the printhead carriage.

The present invention seeks to improve over the prior art by providing a printhead carriage which is driven along the printing path using a principle of differential motion whereby gross movements in a wire, belt or rack causes only a small linear displacement of the carriage, allowing coarse and relatively imprecise mechanical parts to be employed. The present invention further seeks to provide improvement over the prior art by allowing for the motor which moves the printhead to be selectably mounted either on the printhead itself or on the body of the printer, thereby making for a compact construction.

SUMMARY OF THE INVENTION

The present invention resides in a carriage transport apparatus wherein a carriage is constrained to move in a predetermined path, the apparatus including a first portion of band, movable in a first direction relative to the path and operative in response thereto to impart relative movement between itself and the carriage in a first direction sense along the path; and a second portion of band simultaneously movable with the first portion of band by the same distance in a second direction relative to the path and opposed to the first direction and operative in response thereto, to impart relative movement between itself and the carriage in a second directional sense opposed to the first directional sense along the path, for the carriage to be displaced in the path by the difference between the relative movement in the first directional sense and the relative movement in the second directional sense.

In a first preferred embodiment, a differential wheel has a first portion of an endless band looped around a first portion having a first radius of the differential wheel and has a second portion of an endless band wrapped around a portion of itself on a second radius. The band passes around spaced pulleys, one of the pulleys being an idler pulley and the other a driven pulley. The differential wheel itself is attached to a carriage bracket constrained to move along the printing path. A coarse stepping motor drives the driven pulley and the action of the differential wheel assures that gross rotation of the driven pulley produces only small linear displacement of the carriage bracket.

In a second preferred embodiment, the stepping motor driving the carriage transport apparatus is mounted on the carriage bracket itself and rotates the differential wheel. The endless band is supported between two idler pulleys and as the differential wheel pays the endless band on and off itself, the carriage bracket moves along its printing path by a relatively small displacement for gross angular displacement of the differential wheel.

In a third preferred embodiment, the endless band, which previously was wrapped around a portion of the differential wheel, is replaced by a toothed timing belt engaging only tangentially with toothed portions of the differential wheel and passing around support pulleys in the same manner as for the endless band.

In a fourth preferred embodiment, the endless band is replaced by solid racks once again tangentially engaging portions of different radii on the differential wheel. In the fourth embodiment, the racks are constrained to move in opposite directions by equal amount by means of a transfer roller held therebetween.

DESCRIPTION OF THE DRAWINGS

The preferred embodiments are hereinafter described in greater detail with reference to the appended drawings in which:

FIG. 1 shows a projected view of a first preferred embodiment of the present invention.

FIG. 3 illustrates the manner in which the endless belt of FIG. 1 passes around the portions of different radii of the differential wheel of FIG. 2.

DETAILED DESCRIPTION OF THE PREFERRED EMBODIMENT

Figure 2:
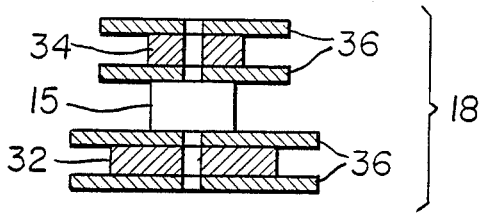
FIG. 2 shows a cross sectional view through the differential wheel of FIG. 1 and depicts in diagrammatic fashion a clutch arrangement interposed between the portions of the wheel.

FIG. 1 shows a projected view of the first preferred embodiment of the present invention.

A printhead carriage 10 in a typewriter or other electro-mechanical printer is constrained to move along a guide rod 12 by a sleeve 14 sliding on the guide rod 12 to allow movement of the printhead carriage 10 along a line of printing as indicated by a first arrow 16. The printhead carriage 10 is shown here as being supported on a guide rod 12 only by way of example. Those skilled in the art will be aware that it is equally possible in the present invention to guide the printhead carriage 10 by tracks, grooves and linear races.

The printhead carriage 10 is provided in the form of a bracket whereon a differential wheel 18 is mounted to rotate. FIG. 1 shows the first preferred embodiment in partially exploded form. The differential wheel 18 comprises an axle 20 for mounting through an opening 22 in the printhead carriage 10. The differential wheel 18 may be rotatably fixed to the printhead carriage 10 in any manner known in the art and the method here given is by way of example.

An endless belt or band 24 is wrapped in a manner (to be described later) around the differential wheel 18, and is supported at its extremities by an idler pulley 26 which is free to rotate without opposition and by a driven pulley 28 rotated by a motor 30.

FIG. 2 shows a cross-sectional view of the differential wheel 18 of FIG. 1 and depicts in diagrammatic fashion a clutch arrangement 15 interposed between portions 32 and 34 which comprise the wheel 18.

The wheel 18 comprises a first circular portion 32 of a first diameter and a second circular portion 34 of a second diameter less than the first diameter. Optional guard rings 36 extend beyond the first 32 and the second 34 portion diameters of the differential wheel 18 to prevent the endless belt 24 from slipping off the differential wheel 18.

FIG. 3 shows how the endless belt 24 is passed around the differential wheel 18. Here, all elements except the endless belt 24 are omitted for clarity.

A first portion 38 of the endless belt or band 24 passes around the first portion 32 of the differential wheel 18 in a first loop 40 and a second portion 42 of the endless belt or band 24 passes in a second loop 44 about the second portion 34 of the differential wheel 18.

As the motor 30 rotates the driven pulley 28, so the first 38 and second 42 portions of the endless belt 24 move in opposite directions as indicated by second 46 and third 48 arrows. When the motor 30 is reversed in direction, so the directions of travel of the first portion 38 and the second portion 42 of the endless belt or band 24 also reverse and remain opposite to one another.

Referring collectively to FIGS. 1, 2 and 3, as the motor 30 rotates the driven pulley 28, so the belt or band 24 is paid out towards and back from the idler pulley 26 which ensures that the movements of the first and second portions 38,42 of the belt are equal and opposite with regard to the overall apparatus (as exemplified by the guide rod 12). The first loop 40 passing around the first portion 32 of the differential wheel 18 causes rotation of the differential wheel 18 which in turn is accompanied by the first portion 32 of the differential wheel rolling along the first portion 38 of the belt 24 by a first distance. Similarly, movement of the second portion 42 of the belt 24 in the second loop 44 around the second portion 34 of differential wheel 18 also causes rotation of the differential wheel 18 which in turn is accompanied by the second portion 34 of the differential wheel 18 rolling along the second portion 42 of the belt 24 by a second distance in the opposite direction to the movement induced relative to the belt 24 by the first loop 40 and the first portion 32 of the differential wheel 18.

Now, the actual movements relative to the belt 24 of the first and second portions 32,34 of the differential wheel are to a large part cancelled by virtue of the movement in opposite directions as indicated by the second and third arrows 46,48 of the belt or band 24. Thus, the residual movement of the differential wheel 18 is caused to be the difference between the distance rolled along the first portion 38 of the belt or band 24 and the distance rolled along the second portion 42 of the belt or band 24. The residual movement is coupled by the axle 20 to the printhead carriage 10 which in turn is constrained to move by the residual motion linearly along the guide rod 12.

By bringing the diameters of the first and second portions 32,34 of the differential wheel 18 very close to equality in value, the motor 30 may be made as coarse as is desired for reasons of economy or control. In the limiting case when the diameters of the first and second portions 32,34 are made exactly equal, no movement may be induced in the printhead carriage 10 no matter how many revolutions the driven pulley 28 may make. As the diameters of the first and second portions 32,34 diverge, so the linear velocity of the carriage 10 per unit angular velocity of the driven pulley 28 increases. The motor 30 may thereby be required to impart multiple revolutions to the driven pulley 28 in order to move the carriage 10 along the rod 12 by just one character printing space. This is in marked contrast to the prior art where such a motor or motor/gearbox assembly would be required to execute only a tiny precise fraction of a revolution.

Equally, the motor 30 can be replaced by solenoids, ratchet devices and other coarse mechanisms which would otherwise be unacceptable in such an application. All that is required of the motor device 30 is that it is capable of rotating the driven pulley 28 by a controlled amount.

Again referring to FIG. 3, while the first 40 and second 44 loops have been shown as consisting solely in a single turn, it is to be appreciated that the loops 40,44 may comprise more than one turn. Further, while the loops 40,44 are shown as having been wound in a particular sense or direction of winding around the first and second portions 32,34 of the differential wheel 18, all that is required in the sense of winding is that, when the belt or band moves as indicated by the second 46 and third 48 arrows, both loops 40,44 tend to urge the differential wheel 18 to rotate in the same rotational direction.

Figure 4:
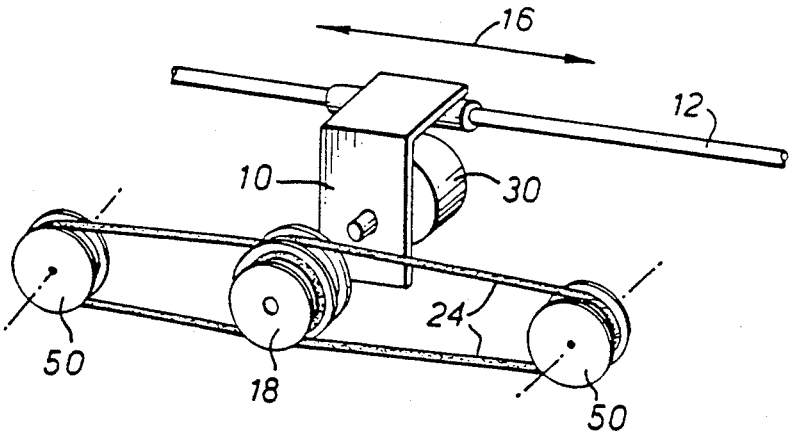
FIG. 4 shows a second preferred embodiment of the invention wherein the motive means has been transferred to the carriage bracket of FIG. 1.

FIG. 4 shows a second preferred embodiment of the invention. The motor 30 has been moved from the body or chassis of the printing mechanism (as shown in FIG. 1) onto the printhead carriage 10 itself and the motor 30 is mounted to rotate the differential wheel 18. The endless belt or band 24 is held at its extremities between a pair of support pulleys 50 which are both idler pulleys and which serve to ensure that motion of one portion 38 of the band 24 is countered by equal and opposite motion of the second portion 42 of the band 24.

Operation is as before save that it is the differential wheel 18 which imparts movement to the band 24 to move the printhead carriage 10 along the guide rod 12. The same provisions concerning the motor 30 and the diameters of the first 32 and second 34 portions of the differential wheel 18 as apply to the first embodiment shown in FIG. 1, also apply to the second embodiment shown in FIG. 2.

Figure 5:
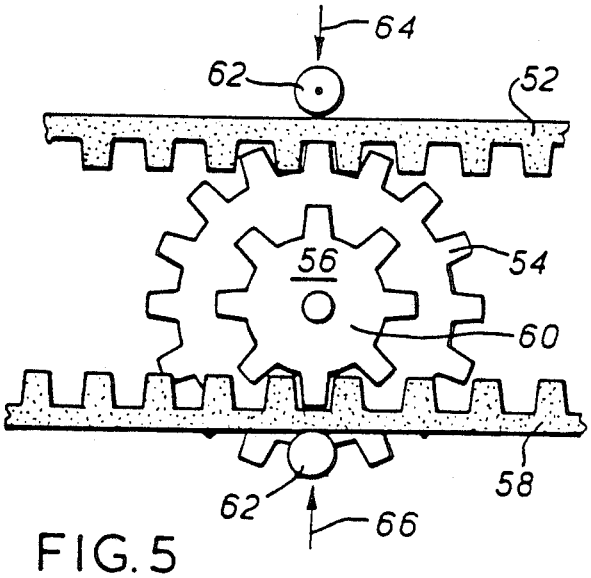
FIG. 5 shows a third preferred embodiment of the invention wherein a toothed timing belt is employed.

FIG. 5 shows a third preferred embodiment of the invention where the endless band or belt 24 is replaced by a toothed endless timing belt or band having a first portion 52 in tangential engagement with a first toothed portion 54 of a differential gearwheel 56 and a second portion 58 in tangential engagement with a second toothed portion 60 of the differential gearhweel 56. Rollers 62 are urged as indicated by fourth 64 and fifth 66 arrows to thrust the first 52 and second 58 portions of the endless timing belt respectively on to their first 54 and second 56 toothed portions of the differential gearwheel 56. The differential gearwheel 56 is mounted upon the printhead carriage 10 in the same manner shown for the first embodiment of FIG. 1 and the second embodiment of FIG. 4. The endless toothed timing belt 52,58 (shown in FIG. 5 only in part) may pass either around an idler pulley 26 and driven pulley 28 arrangement as illustrated in FIG. 1 or may pass around a pair of support pulleys 50 as illustrated in FIG. 4.

Figure 7:
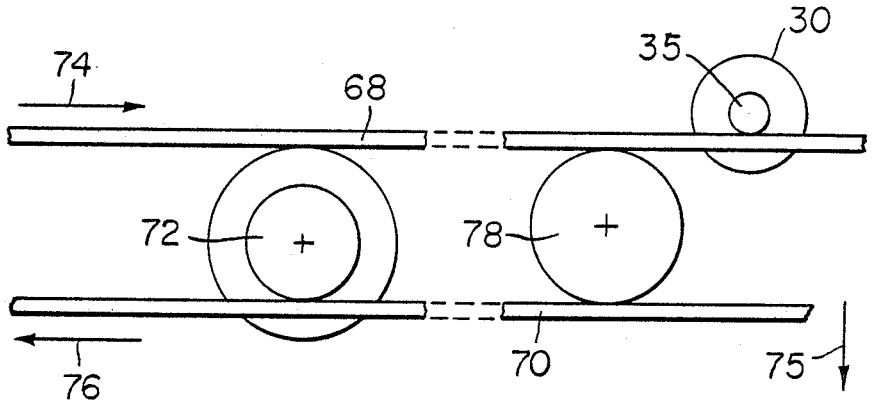
FIG. 6 and FIG. 7 show variations of a fourth preferred embodiment of the invention wherein solid, rigid racks are used to move the differential wheel.
Figure 6:
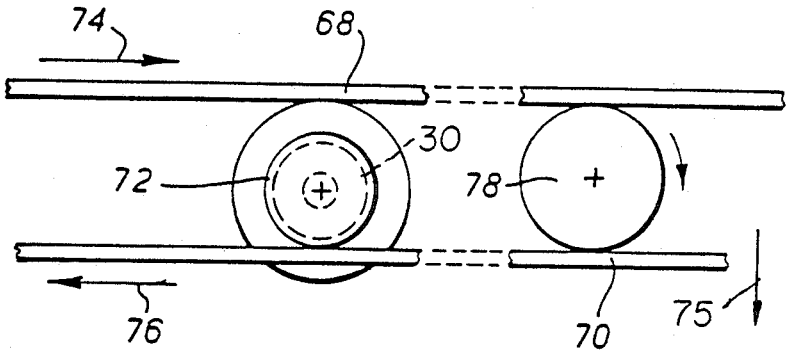

FIG. 6 and FIG. 7 show variation of a fourth preferred embodiment of the invention where the endless belt 24 or the endless toothed belt 52,58 is replaced by a pair of rigid racks 68,70. While FIG. 6 and FIG. 7 show the racks 68,70 as being smooth it is to be understood that they may equally well be toothed and engage a differential wheel 72 substantially identical to the differential gearwheel 56 shown in FIG. 5.

The racks 68,70 move as indicated by sixth and seventh rows 74,76 and a transfer roller 78 is fixed between the first and second rigid racks 68,70 to ensure that movement of the first rack 68 is transferred as equal and opposite movement to the second rack 70. The racks 68,70 roll against the differential wheel 72 in the manner described for the third embodiment of FIG. 5. Either one of the racks 68,70 may be driven or, such as rack 68 in FIG. 7 which is driven by friction gear 35 attached to the shaft of motor 30. Alternately, the differential wheel 72 may be the source of motive power, as seen in FIG. 6 where the shaft of motor 30 is connected directly to the differential wheel 72. The presence of the transfer roller 78 ensures that the two racks 68,70 co-operate to move the printhead carriage 10 in the same manner as does the endless belt 24 and the endless toothed belt 52,58.

The present invention also allows for a rapid carriage return stroke to be imparted to the printhead carriage by disengagement of the rack or belts from one part of the differential wheel.

Turning first to FIG. 5, when it is desired to execute a rapid carriage return, one of the rollers 62 is moved away from its respective portion of the endless timing belt 52,58 allowing that portion of the timing belt to disengage from its portion 54,60 of the differential gearwheel 56. When the motor 30 is mounted as shown in the second embodiment of FIG. 4, the remaining toothed portion 54,60 of the differential gearwheel 56 engages only one half of the toothed belt 52,58 and the carriage 10 is moved along that portion, when the portion is held immobile, at high speed. Thus the removal of one of the portions 52,58 of the endless toothed timing belt from the differential gearwheel 56 is accompanied by clamping of one of the support pulleys 59 to immobilize the belt 52,58.

With regard to FIG. 6, all that is necessary to achieve the rapid carriage return is to lift one or the other of the racks 68,70 away from the differential wheel 72 (for example, rack 70 may be moved in the direction of arrow 75), to clamp the transfer roller 78, and then, with the motor 30 on the printhead carriage 10 as shown in FIG. 4, to allow the differential wheel 72 to transfer rapidly along the rack 68 with which it is still in contact. With regard to FIG. 7, to achieve the rapid carriage return, rack 70 may be moved away from differential wheel 72 in the direction of arrow 75; and motor 30 via its friction gear 35, will allow the differential wheel 72 to transfer rapidly along the rack 68 with which it is still in contact.

With regard to FIG. 4, all that is necessary to achieve a rapid carriage return is to ensure that the first 32 and second 34 portions of the differential wheel 18 are selectably independently rotatable. This may be achieved by provision, for example, of a magnetic or other clutch arrangement 15 (FIG. 2) between the first 32 and second 34 portions of the differential wheel 18 whereby one or the other of the portions 32,34 is rendered free to rotate, that is, is not constrained to rotate with the shaft of the motor 30. In order then to execute a rapid carriage return, one of the support pulleys 50 is clamped, the freely rotating portion 32,34 of the differential wheel 18 is freed, and the motor 30 caused to rotate.

While in the above embodiment the motor 30 has been shown as imparting direct drive either to the differential wheel 18 or to the driven pulley 28, it is to be appreciated that a gearbox may be employed between any motor and any driven element.

The present invention has hereinbefore been described with reference to a printing apparatus. Those skilled in the art will appreciate that many other applications for the present invention exist, in any machinery where a carriage assembly requires to be precisely positioned.

While the preferred embodiment hereinbefore described shows the differential wheel 18,56,72 as comprising portions of different diameters, in the present invention it is possible to replace the portions of different diameters by mutually geared portions whose rates of revolution on the axle 20 or motor shaft are thus rendered different.

I claim:

1. A printer carriage transport apparatus wherein a carriage is constrained to move in a predetermined path, said apparatus comprising:

a flexible, endless common band having a first portion and a second portion;

motive means comprising a single differential wheel means rotatable mounted on said carriage, said motive means being coupled to said first and second portions of band, said motive means for moving said first portion of band in a first direction along said path and for imparting relative movement between said first portion of band and said carriage in a first directional sense along said path;

said motive means further for moving said second portion of band simultaneously with said first portion of band and by the same distance in a second direction along said path and opposed to said first direction, said motive means for imparting relative movement between said second portion of band and said carriage in a second directional sense opposed to said first directional sense along said path;

whereby said carriage is displaced in said path by the difference between said relative movement in said first directional sense and said relative movement in said second directional sense;

said differential wheel means including a differential wheel having a portion of a first diameter engaging said first portion of band and a portion of a second diameter engaging said second portion of band;

said first portion of band passing at least once around said portion of said differential wheel of said first diameter and said second portion of band passing at least once around said portion of said differential wheel of said second diameter;

disengage means for disengaging said first portion of band from imparting said relative movement between said first portion of band and said carriage, whereby rapid transport of said carriage in said path by said relative movement between said carriage and said second portion of band may be achieved

2. An apparatus according to claim 1 wherein said common band is supported between a first idling pulley and a second idling pulley.

3. An apparatus according to claim 1 wherein said flexible, endless common band is supported at one extremity by a driven pulley, said apparatus including rotation means for rotating said driven pulley.

4. A carriage transport apparatus wherein a carriage is constrained to move in a predetermined path, comprising:

drive means for providing rotational movement;

differential wheel means mounted on said carriage, for moving said carriage;

linking means, coupled to said drive means and said differential wheel means, for transmitting forces and torques therebetween;

said differential wheel means including a differential wheel having a portion of a first diameter and a portion of a second diameter, said differential wheel being rotatable mounted on said carriage and providing translational motion to said carriage in response to the rotation thereof;

said linking means including a flexible, endless common band having a first portion and a second portion, said first portion of said band engaging said portion of said differential wheel having said first diameter and said second portion of said band engaging said portion of said differential wheel having said second diameter;

said first portion of said band passing at least once around said portion of said differential wheel of said first diameter, said second portion of said band passing at least once around said portion of said differential wheel of said second diameter; and means for allowing one of said portions of said differential wheel to rotate freely.

5. The apparatus according to claim 4 wherein said drive means further includes a driven pulley and an idler pulley, each of said pulleys supporting an extremity of said continuous band.

6. The apparatus according to claim 5 wherein said drive means includes a motor fixedly mounted on a support, the shaft of said motor coupled to said driven pulley.

7. The apparatus according to claim 4 wherein said band is supported between first and second idler pulleys.

8. The apparatus according to claim 4 wherein said carriage is coupled to a guide rod by a sleeve.

9. The apparatus according to claim 4 wherein said drive means further includes a pair of idler pulleys, said pulleys supporting respective extremities of said continuous band, and further including a motor fixedly mounted on said carriage, said motor having a shaft directly coupled to said differential wheel means.

10. A carriage transport apparatus wherein a carriage is constrained to move in a predetermined path, comprising:

drive means for providing rotational movement;

differential wheel means mounted on said carriage, for moving said carriage;

linking means, coupled to said drive means and said differential wheel means, for transmitting forces and torques therebetween;

said differential wheel means including a differential wheel having a portion of a first diameter and a portion of a second diameter, said differential wheel being rotatably mounted on said carriage and providing translational motion to said carriage in response to the rotation thereof;

said linking means including:

a first rigid rack engaging said portion of said differential wheel of said first diameter;

a second rigid rack engaging said portion of said differential wheel of said second diameter; and a transfer roller engaging both said first rigid rack and said second rigid rack to ensure that movement of said first rigid rack is transferred as equal and opposite movement to said second rigid rack.

11. The apparatus according to claim 10 wherein said drive means is coupled to said differential wheel.

12. The apparatus according to claim 10 wherein said drive means is coupled to one of said racks for movement of said one of said racks in said predetermined path.

13. The apparatus according to claim 10 further including means for disengaging one of said racks from said differential wheel, said means further for clamping said transfer roller.

14. The apparatus according to claim 10 wherein said portions of said differential wheel of said first and second diameters each include gear teeth which mesh with respective gear teeth provided on said first and second racks respectively.

* * * * *